United States Patent [19]

Banker

[11] Patent Number: 4,934,952

[45] Date of Patent: Jun. 19, 1990

[54] CORROSION RESISTANT BONDING STRAP

[75] Inventor: John G. Banker, Boulder, Colo.

[73] Assignee: Explosive Fabricators, Inc., Louisville, Colo.

[21] Appl. No.: 329,511

[22] Filed: Mar. 28, 1989

[51] Int. Cl.[5] ..... H01R 4/66; H01R 13/03

[52] U.S. Cl. ..... 439/92; 439/502; 439/887; 228/175

[58] Field of Search ..... 439/92, 502, 503, 887; 228/140, 175

[56] References Cited

U.S. PATENT DOCUMENTS

| | | | |
|---|---|---|---|
| 3,360,848 | 1/1968 | Saia | 228/107 |
| 4,485,960 | 12/1984 | Sagan et al. | 228/175 |
| 4,600,332 | 7/1986 | Sharp et al. | 228/140 |
| 4,765,530 | 8/1988 | Dang et al. | 228/263.21 |

FOREIGN PATENT DOCUMENTS

| | | | |
|---|---|---|---|
| 34083 | 3/1979 | Japan | 439/502 |

OTHER PUBLICATIONS

Military Standard 1310D 1979, "Shipboard Bonding, Grounding, and Other Techniques for Electromagnetic Compatibility & Safety".

"Explosion-Bonded Metals for Marine Structural Applications", by McKenney & Banker, Marine Technology, Jul. 1971.

*Primary Examiner*—Gary F. Paumen

*Attorney, Agent, or Firm*—Richard W. Hanes

[57] ABSTRACT

A bonding and electrical grounding assembly for interconnecting dissimilar metallic components, especially in a corrosive environment, which includes a flexible first metal strap having secured to each of its ends a first metal lug for mechanical fastening to a boss which may be welded to one of the major components being bonded. The bosses are each bimetallic, the portion of the boss which is in contact with the lug being constructed of the first metal. The other portion of the boss which is to be welded to the major component is constructed of a second metal, that is the same metal as that of the component. The two dissimilar metals of each boss are directly bonded together by explosive cladding, roll-bonding, friction welding or any process which renders the bimetallic interface impervious to corrosion.

10 Claims, 1 Drawing Sheet

CORROSION RESISTANT BONDING STRAP

BACKGROUND OF THE INVENTION

Modern naval vessels require electrical coupling and common grounding of all on-board metal structures and equipment to prevent inductive pickup of electrical signals and resulting generation of electromagnetic interference in critically important communications and other signal generating and receiving apparatus. When shipboard components cannot be integrally or metallurgically joined to other structures, coupling is typically accomplished through the use of metal straps sometimes referred to as bonding straps, most frequently constructed of copper cable with either stainless steel or aluminum end fittings, depending on the types of metals being bonded. Frequently, the bonding straps are used to couple components constructed of galvanically different metals, such as aluminum and steel, and in the splash-spray environment of shipboard topside where metal components are always exposed to severe corrosive elements their destructive effect is seriously aggravated at the juncture of these dissimilar metals.

The bonding straps of the prior art are typically constructed of copper cable to optimize electrical conductivity. At each end of the cable is an attached lug of a metal type selected to provide metallurgical compatibility with the metal of the component to which the lug is to be attached. Thus, when the shipboard components to be bonded are of different metal types, the lugs on each end of the strap must be of a different type to match the metal to which they will be mated, creating at least two dissimilar metal interfaces in the bonding strap itself. Because of the difficulty of welding the various metals of the strap construction together by conventional means, the components of the strap are mechanically joined, creating crevices and interstices in which corrosion becomes localized and accelerated. The cable and the cable lug crimped joints are usually encased in a shielding material designed to protect the assembly from the corrosive environment, however, currently available sealing materials break down in the topside environment, exposing the galvanically dissimilar metals in the strap to the sea water environment and consequent accelerated deterioration and failure. Recent studies have confirmed that the mean time between failure for bonding straps of the prior art design is less than five years. These corrosion failures often occur at the crimped joint between the cable and the lug.

It is therefore the primary object of the present invention to provide a bonding strap construction which eliminates the corrosion between the dissimilar metals of a strap intended to bond structural components made of dissimilar metals.

A second object of the invention is to provide a bonding strap which minimizes mechanical interconnections.

A further object of the invention is to provide a system of bonding which contemplates that the unavoidable mechanical connections be constructed of similar metals which are galvanically more noble than their dissimilar metal counterparts.

A still further object of the invention is to provide a bonding strap construction which can utilize materials insensitive to crevice corrosion in seawater environments while at the same time exhibiting adequate electrical characteristics such as high conductivity and low magnetic permeability.

Other and still further objects, features and advantages of the present invention will become apparent in the following detailed description of a preferred form of the invention.

THE PRIOR ART

The most pertinent prior art resides in the current U.S. Government specification for bonding straps, MIL-STD-1310D 1979, entitled "Shipboard Bonding, Grounding, and Other Techniques For Electromagnetic Compatibility and Safety."

Pertinent prior art with respect to the technique of explosive cladding of dissimilar metals can be found in the basic disclosures of this process taught in U.S. Pat. No. 3,360,848 and the references referred to therein.

A paper entitled "Explosion-Bonded Metals For Marine Structural Applications" by Charles R. McKenney and John G. Banker, published July 1971 in *Marine Technology,* discusses the advantages of explosively bonded welding transition joints on marine vessels.

SUMMARY OF THE INVENTION

The bonding strap of the present invention comprises a flexible braided metallic strap which is mechanically attached at each of its ends to a bimetallic boss. The strap and its fastening accessories, together with the strap contacting ends of each boss, are all constructed of the same metal type to eliminate the aggravated galvanic corrosive effects caused by dissimilar metals in mechanical contact. The portion of each boss which is to become welded to one of the metallic structures being coupled is fabricated of the same metal type as the metal to which the union will be made, in order to permit a welded attachment. The two dissimilar metals of the boss are bonded by a non-fusion welding technique such as explosive welding which renders the dissimilar metal interface in the boss impervious to corrosive influences.

DETAILED DESCRIPTION OF PREFERRED FORM

Figure 1:
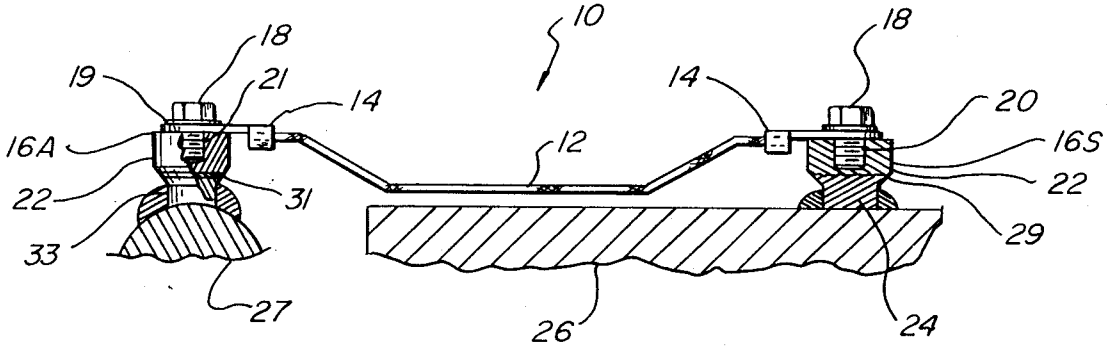
FIG. 1 is a side elevation view of the bonding strap with portions of the bosses broken away and shown in cross section.
Figure 2:
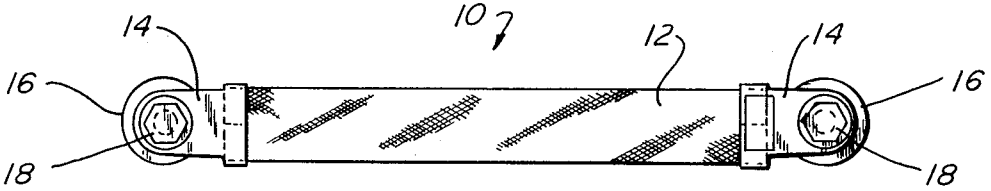
FIG. 2 is a top plan view of the bonding strap structure.

A bonding strap 10, made according to the present invention, is shown in FIGS. 1 and 2. Preferably, the ends of the strap assembly, that is the bosses 16A,S, should be made suitable for welding to aluminum and/or steel, depending upon the metal types of the components being bonded. The choice of the metal for the balance of the assembly is driven by considerations regarding corrosion resistance, electronic characteristics, bondableness, and cost.

It has been determined that electrical conductivity is not highly critical in strap performance. However, magnetic permeability is a material characteristic which has a significant effect upon strap inductance. It is critical that the metal be non-ferromagnetic with a permeability of essentially unity. This requirement eliminates from consideration the iron-based alloys, except the austenitic stainless steels, and the nickel based alloys including Monel 400. The copper-nickel alloys with greater than 50% copper are acceptable.

The strap 12 is constructed from a metal that is galvanically superior to both aluminum and steel so that it cannot become a sacrificial anode to the structure being bonded. This requirement eliminates both aluminum and carbon steel from consideration. Since elimination of crevices in the strap assembly is virtually impossible, the metal selected must be highly resistant to crevice corrosion in a seawater environment. This parameter eliminates common austenitic stainless steels. All factors considered, the best metals for resistance to chloride crevice corrosion are the copper-nickels. Alternate, but higher cost, acceptable metals for this purpose are titanium and some of the exotic austenitic stainless steels.

As a further requirement, the strap 12 and lugs 14 must be constructed from metals that can be welded together economically. Providing that the nickel content of the copper-nickel metals is above about 20%, these metals are readily joined using virtually all common fusion welding processes. Using solid-state welding processes such as explosion welding or friction welding, coppernickel can be metallurgically welded to both steel and aluminum.

The combination of all of these considerations results in the selection of the copper-nickel alloy family with nickel content ranging from 20% to 50%, as the preferred material for the strap and lugs.

The configuration of the strap 12 is mandated by electronic and flexibility requirements and the requirement for a fully welded strap assembly. The electronic requirements can be met with either a rectangular or round configuration. However, a round cable of the required inductance characteristics would be about 20 times heavier than an equivalent flat braid. Since metal cost is the most significant factor in cable or braid cost, the round configuration is significantly more expensive. Although both round and flat strap configurations can be welded to the end lugs, the flat option lends itself to lower cost, high volume welding processes.

Each of the lugs 14 is fastened to the top surface of a bimetallic boss 16A or 16S by a bolt 18 threaded into a longitudinal bore 20 in the boss 16A,S. To minimize corrosion at the strap-to-boss connection, the top portion 22 of the boss 16 is constructed of copper-nickel to match the strap lug 14. The bolt and its associated washers and retaining rings are constructed of. A lock washer 19 is provided beneath the bolt head to maintain the bolt in its fastened position in the boss.

The base 24 of one of the bosses 16S is carbon steel for ease of welding to steel structures 26. The top surface of the coppernickel portion is machined for good electrical contact with the lug 14. The steel base is reduced in diameter to facilitate welding onto flat surfaces or curved surfaces such as pipes and stanchions. The copper-nickel portion 22 is directly bonded to the steel 24 using any of several processes including explosion welding, roll bonding, or friction welding. The heat of welding during installation of the bonding strap assembly to shipboard components will not deleteriously affect this joint 29.

The fabrication considerations just mentioned for a steel based boss are equally applicable for copper-nickel/aluminum bosses to be welded to aluminum structures 27, except in regard to thermal stability of the joint. The mechanical integrity of a direct bond between copper-nickel and aluminum can be severely degraded by overheating during installation welding. To alleviate this problem, a thin layer of titanium 31 is inserted between the aluminum base 33 and the copper-nickel upper portion 22 of the one boss 16A.

I claim:

1. A bonding and electrical grounding assembly comprising in combination:

a flexible braided elongated strap made of a first metal;

a pair of lugs made of said first metal metallurgically joined to the respective ends of the strap;

at least one boss member comprising first and second bimetallic portions metallurgically bonded together where the first portion is of said first metal and the second portion is of a second metal; and fastener means of said first metal interconnecting a said lug and only the first portion of a respective said boss.

2. The combination of claim 1 where the bimetallic bond of the boss members is produced by explosive welding.

3. The combination of claim 1 where the bimetallic bond of the boss members is produced by roll bonding.

4. The combination of claim 1 where the bimetallic bond of the boss members is produced by friction welding.

5. The apparatus of claim 1 where the first metal is a coppernickel alloy.

6. The apparatus of claim 1 where the first metal is titanium.

7. The apparatus of claim 1 where the first metal is an exotic austenitic stainless steel.

8. The combination of claim 1 where the first and second portions of a boss are upper and lower segments of the boss respectively.

9. The construction of claim 1 where the first and second portions of a boss are coaxial cylinders.

10. The construction of claim 1 where the second metal is aluminum and further including a layer of titanium between the first metal portion of the boss and the second metal portion.

* * * * *